United States Patent [19]

Kent

[11] Patent Number: 5,020,704

[45] Date of Patent: Jun. 4, 1991

[54] GARMENT HANGER WITH ROTATING PROJECTIONS TO INTRODUCE GARMENTS WITHIN

[76] Inventor: Keith Kent, 806 Richards, Vancouver, British Columbia, Canada, V6B 4A9

[21] Appl. No.: 414,543

[22] Filed: Sep. 29, 1989

[51] Int. Cl.[5] ..... A47G 25/48; A47G 25/14

[52] U.S. Cl. ..... 223/96; 223/95; 223/85

[58] Field of Search ..... 223/85, 89, 93, 94, 223/96, 88, 90, 91, 95; 211/113

[56] References Cited

U.S. PATENT DOCUMENTS

| | | | |
|---|---|---|---|
| 2,889,094 | 6/1959 | Vigor | 223/96 |
| 3,050,222 | 8/1962 | Cates | 223/96 |
| 4,645,106 | 2/1987 | Pawl | 223/94 |

*Primary Examiner*—Werner H. Schroeder
*Assistant Examiner*—Bibhu Mohanty

[57] ABSTRACT

A garment hanger having a base plate and a pair of front plates independently hingedly attached to the base plate. Each front plate is positioned relative to the base plate to form a gripping surface adjacent one edge of the plate. There are springs urging the front plates towards the base plate at the gripping surface.

6 Claims, 2 Drawing Sheets

10
12
14
16
18
24
24
24
26
30

GARMENT HANGER WITH ROTATING PROJECTIONS TO INTRODUCE GARMENTS WITHIN

FIELD OF THE INVENTION

This invention relates to a garment hanger.

DESCRIPTION OF THE PRIOR ART

Garment hangers are well known. Their use requires dexterity and frequently involves the use of the chin. With a traditional triangular coat hanger, the hanger is gripped in one hand and the garment in the other. However, feeding the garment through the hanger, while also maintaining the garment crease-free, can be difficult and it is frequently necessary to grip the garment beneath the chin while passing the free end through the hanger with the other hand.

Furthermore, such a hanger can only in practice handle one garment.

Spring-loaded hangers are known. In general, they comprise two spaced apart surfaces, urged towards each other to form gripping surfaces. Pressure is applied against the resilient urging of the springs and the gripping surfaces are parted. The garment may then be introduced and the pressure released. The springs then act to close the gripping surface around the garment.

A problem arises because garments are not rigid bodies. Feeding the garment along the length of the hanger can be difficult and, again, usually requires two hands and either laying the garment down on a flat surface or, again, the use of the chin.

The present invention seeks to produce a hanger that greatly facilitates the introduction and removal of garments from the hanger. It allows the hanging of a plurality of garments in the one hanger with ease.

SUMMARY OF THE INVENTION

Accordingly, in its broadest aspect, the present invention is a garment hanger comprising:

a base plate;

a pair of front plates independently hingedly attached to the base plate, each front plate being positioned relative to the base plate to form a gripping surface adjacent one edge of the plate;

resilient means urging the front plates towards the base plate at the gripping surface.

BRIEF DESCRIPTION OF THE DRAWINGS

Aspects of the invention are illustrated, merely by way of example, in the accompanying drawings in which.

DESCRIPTION OF THE PREFERRED EMBODIMENTS

Figure 1:
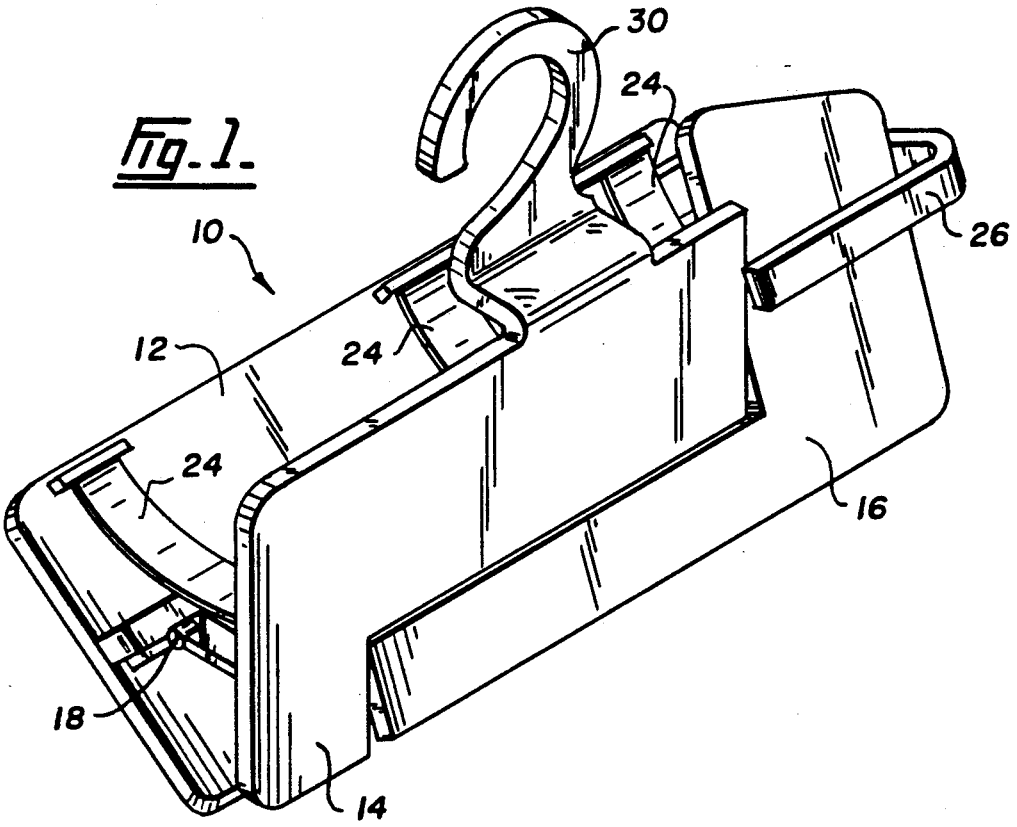
FIG. 1 is a perspective view of one embodiment of the present invention.

The drawings show a garment hanger 10 comprising a base plate 12 and a pair of clamping front plates 14 and 16 independently attached to the base plate 12 by hinges 18. As shown in the drawings, the front plates 14 and 16 are of unequal length and plate 14 therefore has two hinges while plate 16 has one hinge. However, the plates 14 and 16 may be of equal length.

Figure 4:
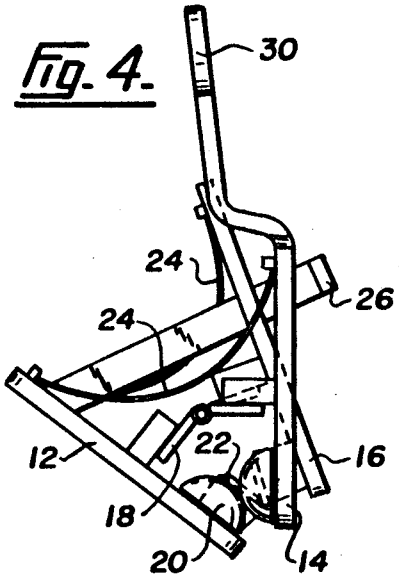
FIG. 4 is an end elevation of the hanger.
Figure 2:
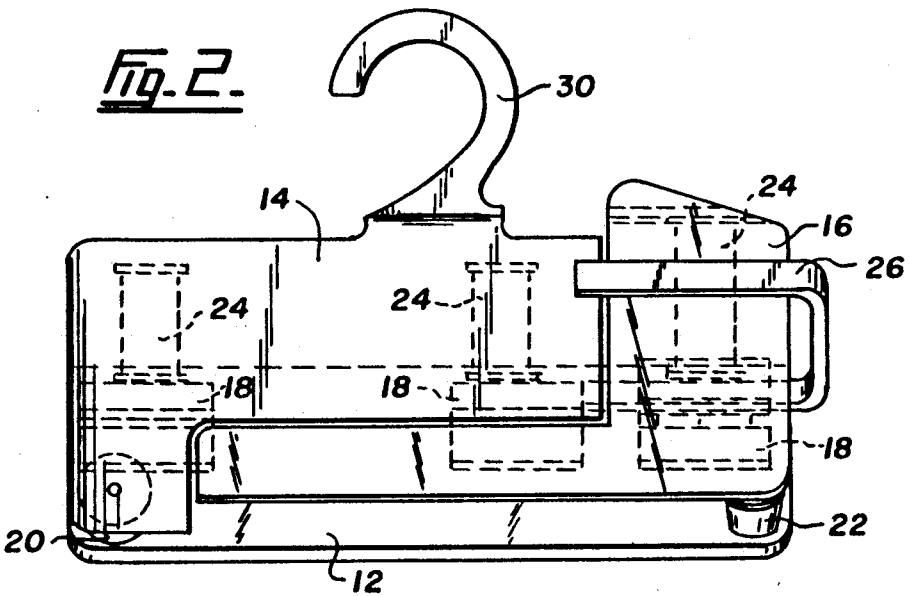
FIG. 2 is a side elevation of the hanger of FIG. 1.

As shown particularly in FIG. 4, each front plate 14 and 16 is positioned relative to the back plate 12 to form a gripping surface adjacent one edge of the plates, the lower edge as shown in the drawings. In the illustrated preferred embodiment the gripping means are defined by pairs of aligned projections 20 and 22. There is one projection of each pair 20 and 22 on the back plate and one projection of each pair on a separate front plate 14 or 16. Two pairs of projections 20 and 22 are sufficient and the use of further projections is not recommended. The first pair of projections 20, as shown in FIG. 4, desirably are rotatable to facilitate the introduction of a garment and, are also rounded again to facilitate the ingress of a garment.

Figure 3:
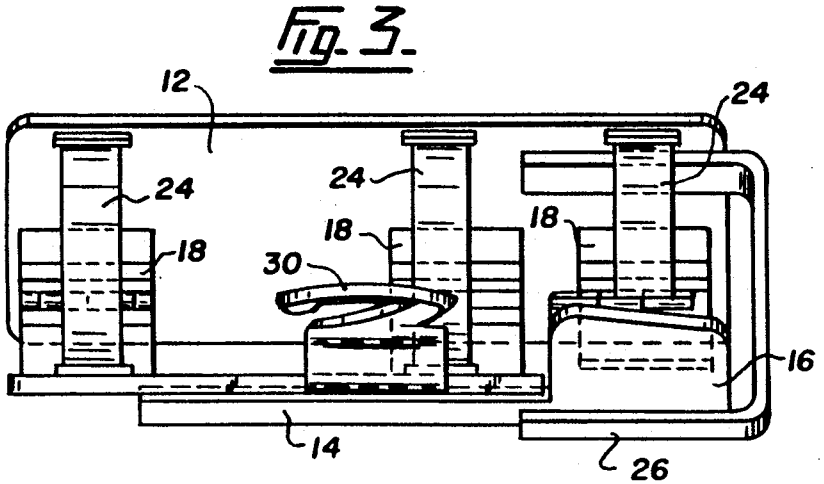
FIG. 3 is a plan view of the hanger of FIG. 1.

There are resilient means in the form of leaf springs 24 urging the front plates 14 and 16 towards the base plate 12 at the gripping surface. The leaf springs are shown most clearly in FIG. 3.

There is a hand or thumb rest 26 adjacent the end of the inner ends of front plates 14 and 16. This rest 26 extends from the back plate 12, around the front plate 16.

The hanger also includes a hook 30 extending from an edge to allow the hanger 10 to be hung. This, of course, is in accordance with conventional practice for a garment hanger.

The essence of the present invention is the independent operation of the two plates 14 and 16 and thus of the two parts of the clamping surface. In use the present invention is gripped with one hand. A garment (not shown) is gripped in the other hand. For a right handed person the palm of the hand is adjacent plate 16 and the thumb presses on plate 14 to part the rotatable projections 20. A garment may then be placed between them and rotated upwardly. The rounded surfaces of the rotatable projections 20 facilitate this ingress. The plate 14 is then released and the thumb is transferred to the rest 26. The palm is used to press on plate 16 to open the projections 22. The garment is then pivoted around the rotatable projections 20 and introduced between the other pair of projections 22. The garment is then firmly gripped.

Because of the independent operation of the separate parts of the gripping surface several garments can be stored as, of course, releasing of one pair of projections 20 or 22 means that a garment already present in the hanger is not completely released, as it would be with the conventional spring-loaded hanger discussed above.

The removal of the garment is the reversal of the above. With the thumb pressed against the rest 26 the palm is used to press plate 16 and to release one edge of the garment. The remaining plate 14 is then pressed to part the projections 20 and release the garment completely from the hanger.

The present invention thus provides a garment hanger that is easy to operate.

The hanger may be made of plastic or metal. It can be easily produced by molding.

The embodiments of the invention in which an exclusive property or privilege is claimed are defined as follows:

I claim:

1. A garment hanger comprising:

a base plate;

a pair of front plates independently hingedly attached to the base plate, each front plate being positioned relative to the base plate to form a gripping surface adjacent one edge of the garment hanger, said gripping surface being defined by pairs of aligned projections, one projection of each pair of projections formed on the base plate and one projection of each pair of projections formed on a separate front plate;

resilient means urging the front plates towards the base plate at the gripping surface.

2. A garment hanger as claimed in claim 1 in which one pair of projections is rotatable to facilitate the introduction of a garment.

3. A garment hanger as claimed in claim 2 in which the rotatable projections have rounded surfaces to further facilitate ingress of a garment.

4. A garment hanger as claimed in claim 1 in which the resilient means comprises a leaf spring extending between the back plate and each front plate.

5. A garment hanger as claimed in claim 1 including a thumb rest adjacent the end of one front plate.

6. A garment hanger as claimed in claim 1 including a hook extending upwardly from the edge to allow the hanger to be hung.

* * * * *